US006871891B2

(12) United States Patent
Rivera Garcia

(10) Patent No.: US 6,871,891 B2
(45) Date of Patent: Mar. 29, 2005

(54) DISPOSABLE PET EXCREMENT COLLECTOR

(76) Inventor: Mario Rivera Garcia, Consejo de Ciento, 139 Bajos, E-08015, Barcelona (ES)

( * ) Notice: Subject to any disclaimer, the term of this patent is extended or adjusted under 35 U.S.C. 154(b) by 0 days.

(21) Appl. No.: 10/380,682

(22) PCT Filed: Sep. 10, 2001

(86) PCT No.: PCT/ES01/00341

§ 371 (c)(1),
(2), (4) Date: Sep. 26, 2003

(87) PCT Pub. No.: WO02/22963

PCT Pub. Date: Mar. 21, 2002

(65) Prior Publication Data

US 2004/0051322 A1 Mar. 18, 2004

(30) Foreign Application Priority Data

Sep. 15, 2000 (ES) ..... 200002316 U

(51) Int. Cl.[7] ..... A01K 29/00; E01H 1/12

(52) U.S. Cl. ..... 294/1.3; 294/25; 15/257.6; 229/117.12

(58) Field of Search ..... 294/1.3–1.5, 55, 294/25; 15/257.6, 104.8; 229/229–231, 117.12–117.17

(56) References Cited

U.S. PATENT DOCUMENTS

| | | | | | |
|---|---|---|---|---|---|
| 3,685,088 | A | * | 8/1972 | Doherty | 294/1.3 |
| 3,848,906 | A | * | 11/1974 | Fleishman | 294/1.3 |
| 4,747,633 | A | * | 5/1988 | Stacy | 294/1.3 |
| 5,186,384 | A | * | 2/1993 | Nelson | 229/122 |
| 5,964,488 | A | * | 10/1999 | Bedel | 294/1.3 |

FOREIGN PATENT DOCUMENTS

| | | | | |
|---|---|---|---|---|
| DE | DT 3521997 | * | 1/1987 | 294/1.3 |
| EP | 454074 A | | 10/1991 | |
| EP | 0897033 A | | 2/1999 | |
| ES | 1033278 U | | 8/1996 | |
| ES | 1044543 U | | 5/2000 | |
| FR | 2599957 | * | 12/1987 | 294/1.3 |
| FR | 2699568 A | | 6/1994 | |
| FR | 2747135 A | | 10/1997 | |

* cited by examiner

*Primary Examiner*—Dean J. Kramer
(74) *Attorney, Agent, or Firm*—Michael Best & Friedrich LLP

(57) ABSTRACT

The collector is constituted from a sheet (1) of stampable material which forms a body with a base (2), some side walls (3) with fold lines (7) to achieve the folding, a rear wall (4) and a continuation of this to serve as cover (5), which is hinged with respect thereto through a fold line (6), so that a fin (10) obtained by stamping on the rear wall (4) allows by means of positioning on two concave sections (13) of that fin (10) the manipulation of the collector and of the actual cover (5), to carry out the collection of excrement from the ground and the closing of such cover (5) the free and toothed edge (15) of which will be in contact with the base (2) in the proximity of the front edge (18) of the latter, that cover (5) being retained in the closed position by the introduction of ribs (16) corresponding to the ends of the toothed edge (15) in respective grooves (17) established for this purpose in the base (2). The cover (5) has on its internal face reinforcing strips (19) with toothed extensions (20) which, as well as stiffening the assembly, determine springs which tend to drive the cover (5) toward the open position.

4 Claims, 3 Drawing Sheets

DISPOSABLE PET EXCREMENT COLLECTOR

OBJECT OF THE INVENTION

The present invention relates to a disposable excrement collector for household pets the evident purpose of which is to permit the collection of the excrement which certain household pets such as dogs defecate, in the streets, parks and other places, so that by means of the collector of the invention said excrement is gathered up in a simple, comfortable and completely hygienic way, without coming into contact with such excrement.

It is therefore an object of the present invention to provide those persons or owners that walk their household pets (such as dogs) in the streets, parks and other places, with a collector which in the inoperative situation remains folded, occupying a minimum volume, which even permits being carried in the pocket, it being possible to unfold manually in a direct manner and without requiring any operation of assembly, to adopt its operative condition and allow the direct collection from the ground of the excrement originated by the defecation of the animal, the collector being closed, also in a direct manner, once the excrement is in the interior, to be discarded or deposited in a waste container avoiding thereby the soiling of city streets and parks, and with this the problems of hygiene and pollution that the excrement of said domestic animals entail, do not occur.

BACKGROUND OF THE INVENTION

The problem is well known that currently exists with the excrement of animals in the streets, there being numerous solutions for the collection of said excrement in a hygienic and comfortable way.

In this sense, excrement collectors are known incorporated by a collector body with a long handle which avoids the user having to stoop to gather up the excrement of the animal.

Although the use of this type of collector is comfortable for the user, the size of said collector is excessively big and, consequently, it is not appropriate for one to carry.

There are also disposable collectors which incorporate a collector body incorporated from a substantially rigid laminar material, in the interior of which is a bag for receiving the excrement of the animal. The main drawback of this type of collector is the need to have a bag as well as the collector body, which results in it being structurally complicated and consequently expensive.

The aforementioned problems are partly resolved by means of a type of collector incorporated from a laminar piece of material which can be stamped, preferably cardboard, which configures a hollow body when mounted, with a base, a rear wall, some side walls and an extended cover, through a fold line which in turn acts as a hinge for the rear wall, so that this type of container in many cases is foldable in order to be carried occupying a minimum volume, and be possible to unfold for its use, in which case the cover can come with means for gripping manually to perform not only the manipulation thereof but also of the collector assembly, facilitating the unfolding, subsequent collection of the excrement directly from the ground through the base, and subsequent closing of the cover for depression of the latter, all of which being discarded in a waste bin.

In this sense, mention can be made of the French Patent with publication number 2699568, in which a collector of the referenced type is disclosed, one of the drawbacks of which is that the unfolding requires an assembly and manipulation of the side walls so that these are secured to the rear wall, as well as not offering sufficient stiffness, since none on its parts is appropriately strengthened, and not including manual means of holding, it being necessary to grasp the whole collector for manipulation thereof.

Mention can also be made of the European Patent 0891542 B1 wherein the collector has side walls with a fold line to allow folding/unfolding. The drawback that the collector of this patent has, is in the closing of the cover which requires some lateral ribs to be housed in respective grooves of the side walls and for this it is necessary to grasp the actual cover, which can give rise to there being contact with areas of the cover which have been soiled with excrement. Nor does it include appropriate means of stiffening.

In the U.S. Pat. No. 4,747,633, another collector is disclosed defined by two symmetrical parts hinged by a common fold line, so that both parts can be separated to determine the opening and allow the gathering up of the excrement, and then be closed to form a hollow body with the excrement in its interior. This collector has the drawback of its structural complexity, since it is formed by two parts, although they are of the same piece.

Finally, in the European Patent 0897033 A1, another collector is described of the type referred to in the French Patent 2699568, with the same drawbacks as this.

DESCRIPTION OF THE INVENTION

The excrement collector that is disclosed, based on the descriptions in the patents mentioned above in the preceding section, offers a series of innovations from which advantages arise, being simple structurally, economic, easy to handle and use, functionally effective and hygienic.

More specifically, the collector of the invention is of the type of those obtained from a sheet of stampable material, such as cardboard, with a base, some folding side walls, and a folding cover, presenting as one of the characteristics of innovation the fact that the cover has a stamped part which results in a fin with a special form for the applying thereupon of two fingers of the hand, allowing the user easy and comfortable handling both of the cover and of the collector assembly, without risk of coming manually into contact with the internal surface, which avoids the possibility of coming into contact with the excrement which could soil the internal walls when gathering up the defecation and closing the cover.

In a form of preferred embodiment, the stamped part and therefore the aforementioned fin, is cup-shaped, that is, with an outline in which two straight sections corresponding to the bases are defined, it being through the smaller section that the fin is linked to the cover, since both the other straight section and the two which are inserted between the previous ones, are free, so that those two side sections define concave edges so that the user can pass the index and middle finger through them, for the purpose of being able to open or to close the cover, at the same time that in that position the user is holding the side walls with the thumb and little finger, facilitating the manipulation or handling of the collector assembly.

Another characteristic of innovation consists in that the free edge of the cover is defined by a rim in saw tooth form which is press-fitted on the internal surface of the base, when performing the closure, as well as having a pair of end ribs which lodge in grooves provided for this purpose in said base, there being no need for manipulation whatsoever to achieve the engagement of such ribs, since the sliding of the edge of such cover over the base, signifies that those ribs reach the grooves of the base and are located therein with no need for any other kind of manipulation.

Another characteristic of innovation consists in that the cover includes some reinforcements abutting on its internal face, defined by strips which can be of more or less width, and even occupy the entirety of the width of the cover, which are prolonged over its edge or internal end in toothed extensions, defining an elastic medium acting as a spring for such cover, tending to open the latter.

The strips of reinforcement, as well as stiffening the cover, act as a means which collaborates in maintaining the closure due to the stiffness which the same provide, which causes the end ribs of the edge of the cover to remain housed in the groove of the base, when the corresponding closure is carried out.

The base has on its internal surface some peripheral reinforcement bands, those of the front edge determining a step after which the grooves are provided in which the end ribs of the cover fit precisely, to maintain the container closed.

DESCRIPTION OF THE DRAWINGS

To complete the description that is being made and with the object of assisting in a better understanding of the characteristics of the invention, in accordance with a preferred example of practical embodiment thereof, attached as an integral part of said description, is a set of drawings wherein by way of illustration and not restrictively, the following has been represented.

PREFERRED EMBODIMENT OF THE INVENTION

Figure 1:
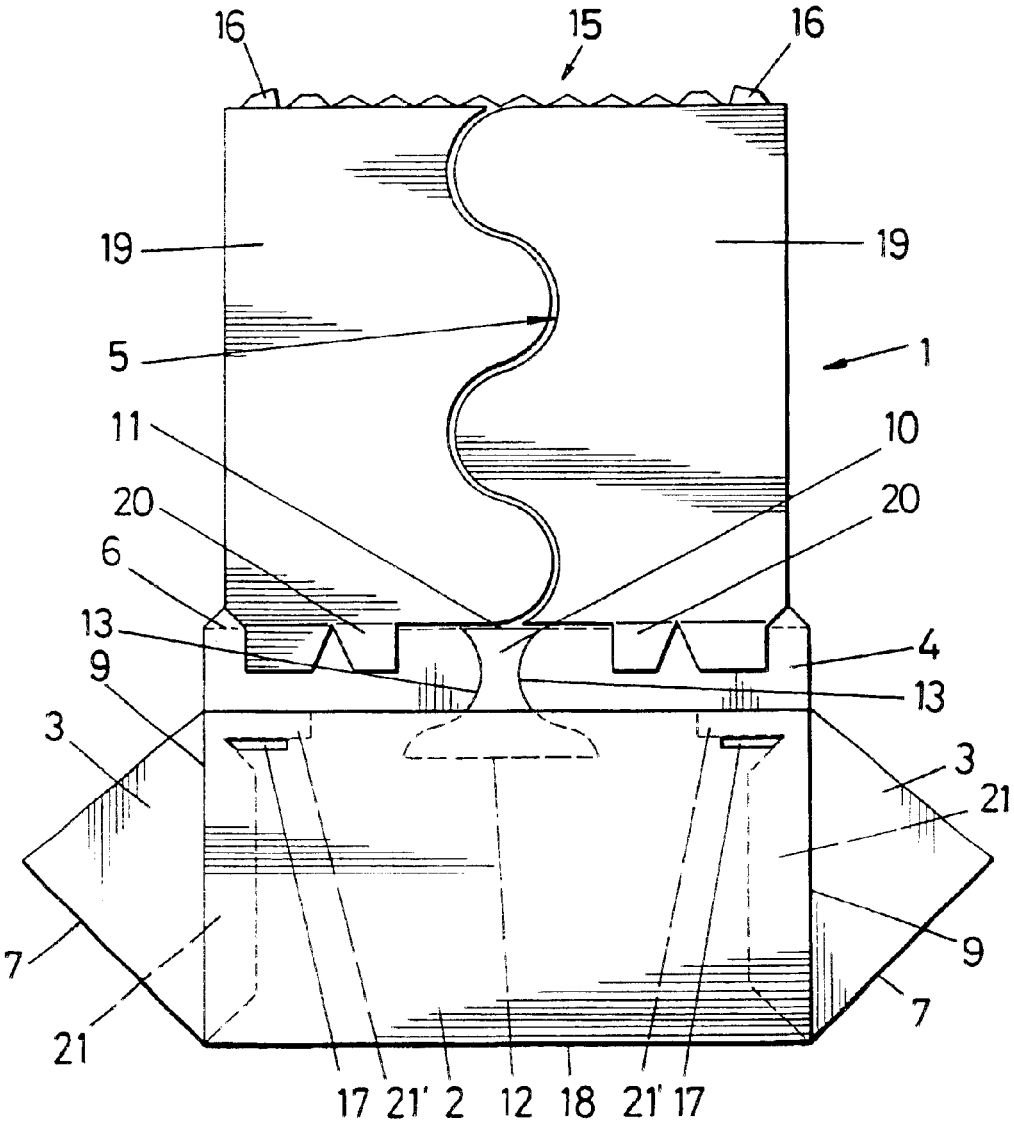
FIG. 1 shows a plan view, in the folded position, of the container object of the present invention.

As can be seen in the referenced figures, the excrement collector object of the present invention is constituted from a sheet (1) of stampable material, as for example cardboard or another similar material, so that when duly provided with the cut and fold lines, it facilitates the assembly of the actual collector, in which is established a base (2) receptor of the excrement to be gathered up, some side walls (3) provided with a fold line (7) to allow the folding as will be described below, and a rear wall (4), which is prolonged in a cover (5) which is attached capable of being folded with respect to the rear wall (4) through a fold line (6) which acts as a hinge means between said rear wall (4) and cover (5).

The fold lines (7) of the side walls (3) allow the folding of the latter by being hinged, through respective fold lines (8) and (9), in the first case with respect to the base (2) and in the second case with respect to the rear wall (4), so that the collector assembly occupies a minimum space insofar as thickness is concerned, since this will be determined by the overlapping of the base (2), side walls (3), rear wall (4) and cover (5), which permits the container to be carried in the pocket, and at the time of requiring its use the unfolding thereof as will be explained below.

Based on those characteristics, one of the innovations of the collector is that the rear wall (4) has in its central area and in correspondence with the fold or hinge line (6) between said rear wall (4) and the cover (5), a stamped part with a special configuration, which gives rise to a fin (10) the outline of which presents two straight and opposing sections (11) and (12) and two side sections (13), so that the fin (10) produced by the aforementioned stamping, is linked to the rear wall (4) through the straight section (11), which is of smaller width than the opposing section (12). Clearly the fin (10) resulting from the stamping determines a window (14) in the actual rear wall (4) of the collector.

Moreover, it has been foreseen that the free edge or end of the cover (5) has a toothed part (15), and on the end parts of that toothed part (15) some ribs (16) intended to lodge, when closing the cover (5) on the base (2), in windows (17) foreseen in the proximity of the front edge (18) of said base (2), so that those ribs (17) maintain the closed position of the cover (5) on the base (2) once the excrement is gathered up and contained in the interior, since such excrement will be situated on the bottom which constitutes said base (2) and retained by the side walls (3) and by the cover (5) in its closed position, and logically with the rear wall (4).

Also, the internal face of the cover (5) is provided with some strips (19) abutting and properly secured by adhesive or by any other conventional system of that internal face of the cover (5), which strips (19) can occupy the entire width and determine some reinforcements for stiffening the cover (5) in question, the internal end of those strips (19) each having a toothed prolongation (20) which acts as a spring which tends to open the cover (5) by the thrust of such toothed extensions (20) against the internal face of the rear wall (4) of the collector.

The bottom or internal face of the base (2) has some peripheral reinforcing strips (21) which, in correspondence with the front edge (18), are prolonged in small extensions (21') after the rear edge of which the windows (17) are located, whereby the closing of the cover (5) takes place by the sliding operation of the ribs (16) through those extensions (21') which will form a step with respect to the base (2), so that after passing over such extensions (21') the ribs (16) will lodge in the windows (17), the cover (5) being in this way perfectly retained in its closed position.

Figure 2:
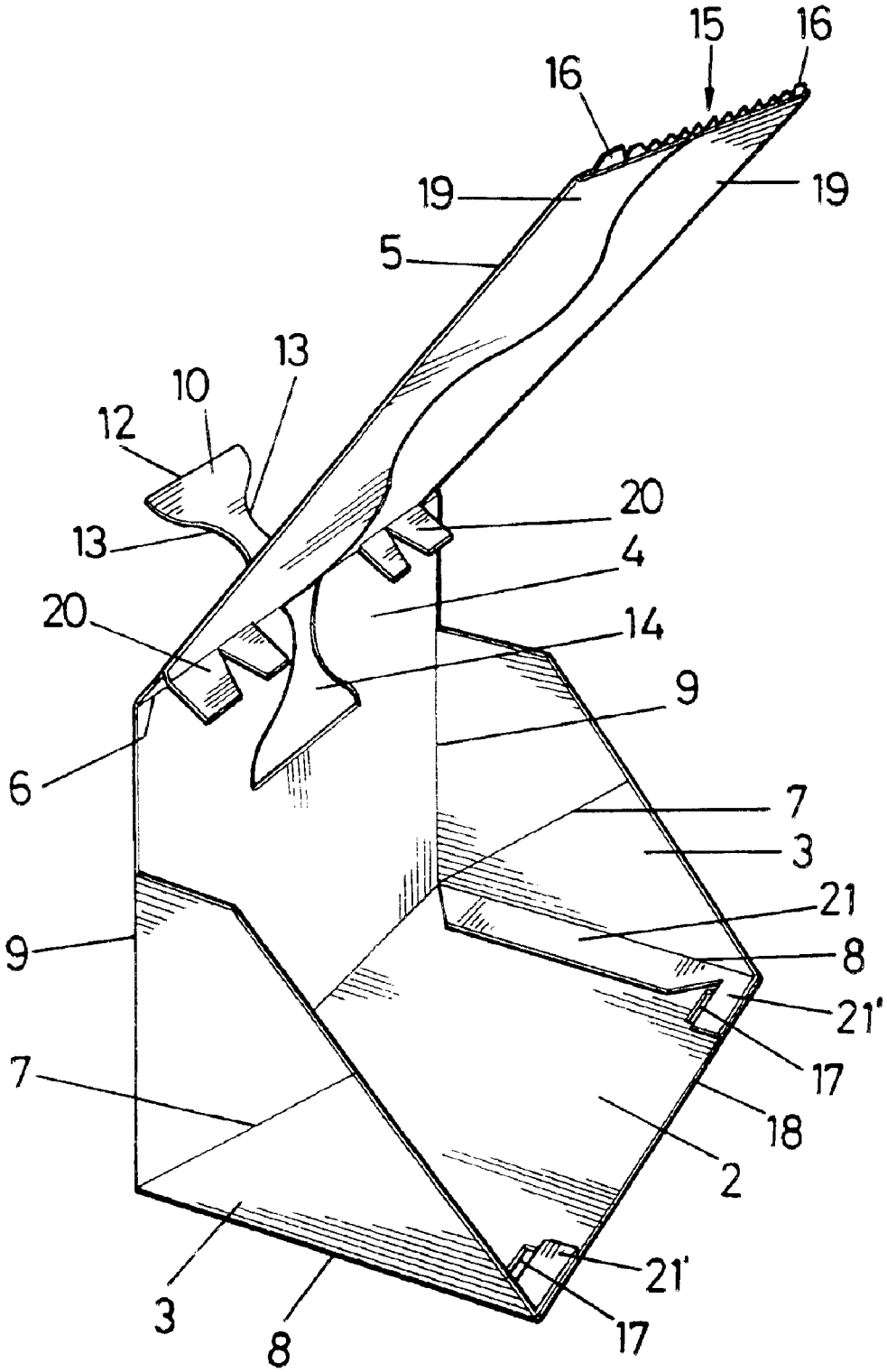
FIG. 2 shows a representation in perspective in the open position of the container represented in the previous figure.
Figure 3:
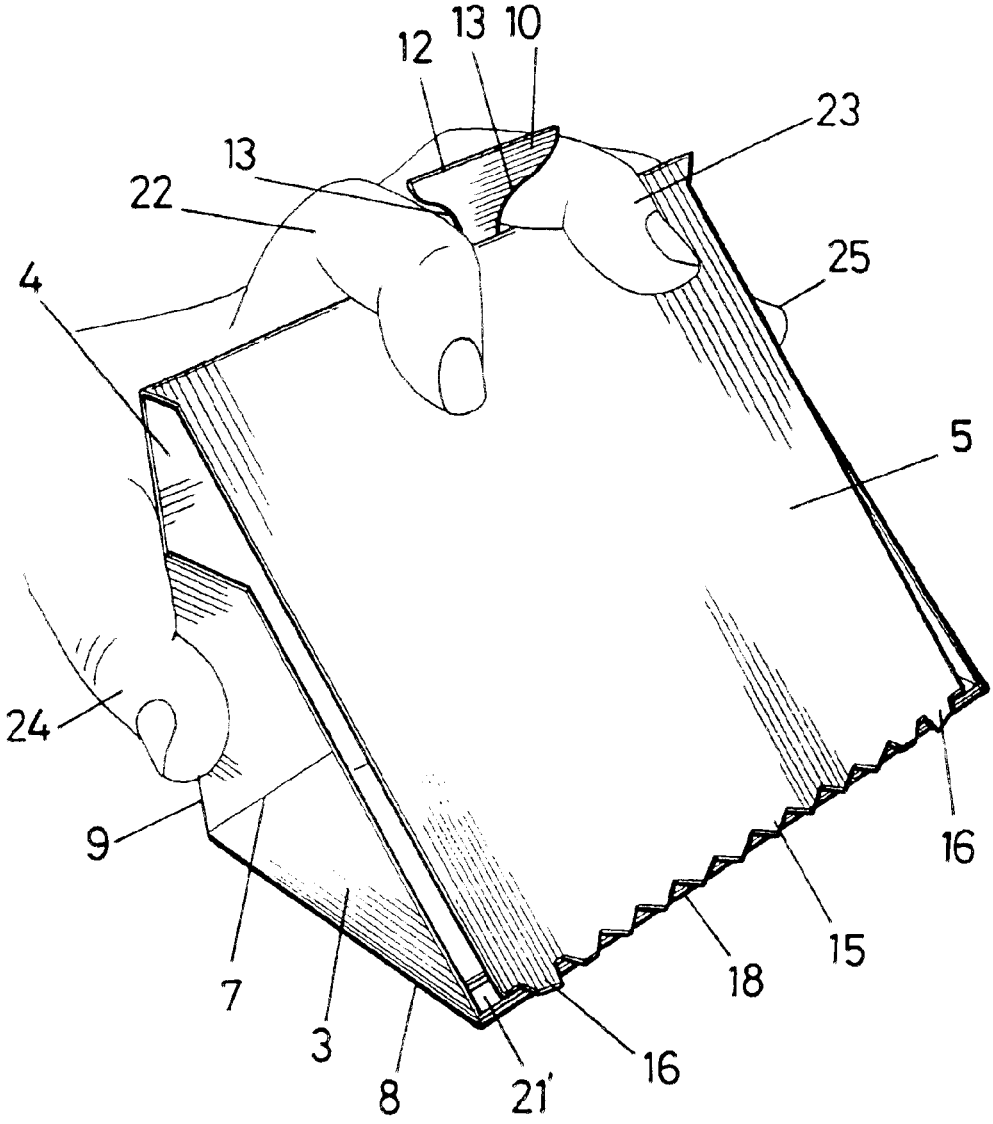
FIG. 3 shows, finally, a view in perspective corresponding to a closed position of the actual container, showing also the manner in which the user grasps or holds said collector for its manipulation.

In FIG. 3, the form of using the collector is shown, being in this figure in the closed position, so that in the unfolded or open position as is represented in FIG. 2, it will suffice to locate the index finger (22) and middle finger (23) on the concave sections (13) of the fin (10), at the same time as the thumb (24) and the little finger (25) rest on the external surface of the side walls (3), which not only allows the manipulation of the collector to be carried out but also the closing of the cover (5) merely by pressing and effecting the pushing of such cover (5) in order that the lower toothed edge (15) thereof reaches the front edge (18) of the base (2), and with the continuation of said push pass over the extensions (21') and lodge the ribs (16) in the grooves (17). Clearly, in that position shown in FIG. 3, the user can also open the collector with no problem whatsoever.

What is claimed is:

1. Disposable excrement collector for household pets which, being constituted from a laminar piece of stampable material, in the forming of which an open body is defined by a base receptor of the excrement to be gathered up, a rear wall, a pair of side walls with a fold line to allow folding and unfolding, and a folding cover as prolongation of the rear wall, hinged to the upper edge of the latter by means of a fold line, facilitating on one hand the upward folding of said cover and corresponding opening of the collector to allow the direct collection of the excrement resulting from the defecations made by does or another type of household pets, whilst on the other hand said fold or hinge line of the cover facilitates the folding of the latter to close the opening defined between the two side walls and the base, and enclosing in its interior the excrement gathered up in order to discard the whole assembly in a waste bin, characterised in that the rear wall (4) has in its upper area a stamped part defining a fin (10) having two opposing sections, after extraction of the fin (10) with respect to the rear wall (4), the fin (10) is secured to the rear wall (4) through one of the opposing sections, the fin (10) also having two free sections and a suitable configuration wherein fit an index finger (22) and a middle finger (23) of a user's hand, to allow the manipulation at the same time of the cover (5) and of the body of the collector, through the support of outer fingers (24) and (25) of the hand on the side walls (3) of the actual collector, also characterised in that a free edge (15) of the cover (5), is toothed and in a closed position remains in contact with the base (2), ends of the toothed part of that free edge (15) having two end ribs (16) projecting beyond the toothing itself which fit in respective grooves (17) in the closed position established for this purpose in the base (2).

2. Disposable excrement collector for household pets, according to claim 1, characterised in that an internal face of the cover (5) is provided with some reinforcing strips (19), which are each prolonged by their internal end in toothed extensions (20) to serve as springs which tend to push said cover (5) toward an open position.

3. Disposable excrement collector for household pets, according to claim 2, characterised in that the stamped part defining the fin (10) for manipulation of the cover (5) and of the actual collector, has two straight and opposing sections (11) and (12), of different width, and two concavely curved side sections (13), the fin (10) being linked to the actual rear wall (4) through the section or stretch (11) of smaller width, whilst an opposite side of the concave sections (13) are free for supporting thereupon the index finger (22) and middle finger (23) of the user's hand.

4. Disposable excrement collector for household pets, according to claim 1, characterised in that the stamped part defining the fin (10) for manipulation of the cover (5) and of the actual collector, has two straight and opposing sections (11) and (12), of different width, and two concavely curved side sections (13), the fin (10) being linked to the actual rear wall (4) through the section or stretch (11) of smaller width, whilst an opposite side of the concave sections (13) are free for supporting thereupon the index finger (22) and middle finger (23) of the user's hand.

* * * * *